United States Patent [19]

Cavicchio

[11] 4,043,242

[45] Aug. 23, 1977

[54] CIRCUIT FOR MUSICAL INSTRUMENT

[76] Inventor: Raymond A. Cavicchio, Rte. No. 1, Box 313, Sunapee, N.H. 03782

[21] Appl. No.: 639,460

[22] Filed: Dec. 10, 1975

[51] Int. Cl.[2] ..... G10H 1/00; G10H 3/06

[52] U.S. Cl. ..... 84/1.17; 84/1.01; 84/DIG. 15

[58] Field of Search ..... 84/1.01, 1.16, 1.17, 84/DIG. 2, DIG. 15

[56] References Cited

U.S. PATENT DOCUMENTS

| | | | |
|---|---|---|---|
| 3,402,251 | 9/1968 | Bright | 84/1.17 |
| 3,555,166 | 1/1971 | Gasser | 84/1.17 |
| 3,567,838 | 3/1971 | Tennes | 84/1.17 XR |
| 3,837,254 | 9/1974 | Southard | 84/1.01 |
| 3,929,051 | 12/1975 | Moore | 84/1.17 |

*Primary Examiner*—E. S. Jackmon
*Attorney, Agent, or Firm*—Wolf, Greenfield & Sacks

[57] ABSTRACT

An electronic circuit connected to and operated by the bass buttons of an accordion to simulate a string bass instrument. The circuit can be disposed in the accordion or remote from the accordion. Each button has a switch associated therewith which couples to means for generating a fixed frequency signal indicative of the actuated button. Signals over a two octave range may be generated and logic circuitry is provided to effectively expand the single octave of available buttons to greater than the single octave such as by a half octave expansion. Output circuitry shapes the output audio signals to allow more or less of the harmonics to pass. A special bass pluck circuit is also provided.

11 Claims, 1 Drawing Figure

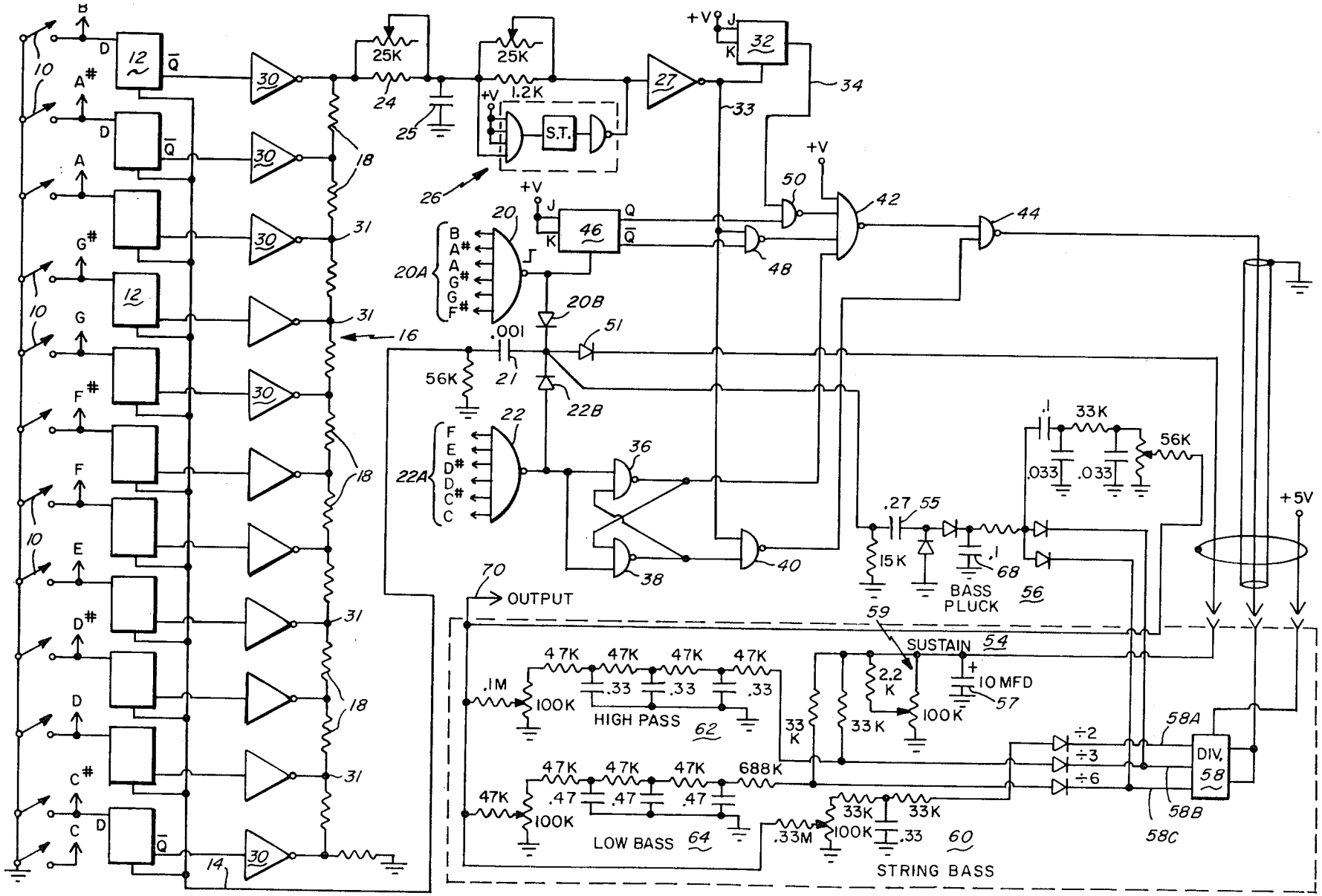
+5V
DIV.
58
58A
58B
58C
÷2
÷3
÷6
56K
33K
.033
.1
68
BASS PLUCK
56
.27
55
15K
SUSTAIN
54
10 MFD
57
100K
2.2 K
33 K
59
33K
100K
.33
STRING BASS
60
.33M
688K
47K
.33
HIGH PASS
62
.47
LOW BASS
64
.1M
OUTPUT
70
+V
50
48
42
44
40
36
38
34
32
33
27
46
20B
51
22B
20
21
.001
22
56K
20A
22A
16
26
S.T.
1.2K
25K
24
25
18
31
30
12
14
10
B
A#
A
G#
G
F#
F
E
D#
D
C#
C

CIRCUIT FOR MUSICAL INSTRUMENT

BACKGROUND OF THE INVENTION

This invention pertains in general to a curcuit for use with a musical instrument. More particularly, the present invention relates to an electronic device that is used with an accordion so that when the base buttons are played a string bass instrument is simulated. The device or circuit of this invention may be self-contained within the accordion or it can be disposed remote from the accordion.

A standard accordion has a panel keyboard on the right-hand that covers at least two octaves and has bass buttons on the left-hand side. These base buttons have a set of reeds associated therwith which correspond to an octave of low frequency notes. Because of the necessarily small size of these reeds, they produce very little sound in the fundamental bass frequency. Amplification by standard means using mecrophones is not a satisfactory solution to this deficient bass sound since the upper harmonics associated with these reeds tend to override the fundamental bass frequency. Moveover, it is not practical to equalize out these higher harmonics since the microphone would not then be effective in amplifying the midrange chords which are also produced in the left-hand section of the accordion. Even if these difficulties could be overcome, there still remains the problem that the reed sound has an extremely fast decay which is quite unlike that of a string bass.

Accordingly, one object of the present invention is to overcome the above problems by providing an electronic device that is responsive to the playing of the bass buttons for electronically simulating a bass string instrument.

Another object of the present invention is to provide an electronic device or circuit in accordance with this invention and that provides for a bass plucking sound.

A further object of the present invention is to provide a device in accordance with this present invention and which may be either installed within the accordion or disposed in a unit remote from the accordion and connected by conductor means thereto.

Still another object of the present invention is to provide an electronic device which expands the bass note range from the available single octave to greater than a single octave. This expansion in the disclosed embodiment is by a half octave.

Still a further object of the present invention is to provide an electronic device for use with accordion that simulates a string bass instrument and that can be constructed relatively simply, can be made at a relatively low cost, and is easily installed into an existing accordion.

SUMMARY OF THE INVENTION

To accomplish the foregoing and other objects of this invention, there is provided an electronic device or circuit for use with a musical instrument having bass buttons for simulating a bass string instrument. The device of this invention is preferably for use with an accordion. The electronic device comprises a plurality of switches each associated with a botton and responsive to actuation of its associated button. These switches may comprise suitably supported microswitches which couple to electronic storage devices for storing a signal indicative of the actuation of a switch. Means which may include a resistance controlled square wave generator couple from the plurality of switches and establish two separate audio signals spaced by an octave. When a particular button is actuated, both a first and second octave audio signal is generated of a frequency corresponding to the actuated button. Logic means is included and is responsive to actuation of predetermined ones of the bottons for mutually exclusively selecting one of the first and second octave audio signals. The signal that is selected by the logic means is then coupled to output voice circuitry which may include filter circuitry, amplifier circuitry and an output speaker. A bass pluck circuit is also provided for sharing the audio signal to provide an envelope characteristic of the plucking of a string instrument.

In one embodiment the logic means is operative to essentially expand the single octave bass range corresponding to the single octave of base buttons to an octave and a half. The principle octave is demarcated into two fields. If a note in the first field is played, an audio signal of proper frequency corresponding to that octave is passed. If a note in the second field is played after the playing of a note in the first field, then the logic means determines which frequency octave will be passed.

BRIEF DESCRIPTION OF THE DRAWINGS

Numerous other objects, features and advantages of the invention should now become apparent upon a reading of the following detailed description taken in conjunction with the sole drawing which shows an electronic circuit block diagram of one embodiment of the invention.

DETAILED DESCRIPTION

Referring now to the sole figure which is a schematic block diagram of one embodiment of the circuit of the present invention, the circuitry shown in the drawing may be essentially totally contained within the accordion itself or a portion of the circuitry can be mounted on a circuit board in the accordion while the remainder of the circuitry is disposed remote from the accordion. The concepts of the present invention are discussed in this detailed description with regard to installation in an accordion. However, it is understood that the concepts of the invention may also be practiced with other types of musical instruments especially those using buttons or keys for the playing of notes.

The drawing shows a plurality of switches 10. The common side of each switch 10 connects to ground and the movable side of each switch couples as an output of the logic circuitry described hereinafter and also to a bistable device shown as flip-flop 12. There are a plurality of flip-flops 12. For one octave of operation there are eleven flip-flops 12 and twelve switches 10. Each of the switches 10 correspond to one of the notes C, C, D, D, E, F, F, G, G, A, A, and B. It is noted that the output signals as just identified also couple to the logic NAND gates 20 and 22 which comprise a part of the logic circuitry associated with the invention. Each of the flip-flops 12 has a reset input. These inputs are tied in common to the reset line 14. A positive pulse on line 14 resets all of the flip-flops 12 with the exception of the sole flip-flop that has been set as discussed in more detail hereinafter.

The circuit also comprises a resistor chain 16 which comprises a series of precision resistors 18 which are connected in series; one end of the string of resistors being connected to ground and the other end being coupled by way of a potentiometer 24 to a resistance controlled square wave generator 26. A plurality of inverting amplifiers 30 couple from flip-flops 12 to respective nodes 31 defined by the resistors 18 comprising the resistor string 16. Thus, each of the flip-flops 12 has its output coupled by way of an inverting amplifier 30 to one of the nodes of the resistor string. If, for example, the note G is played the associated switch 10 closes and the G signal is coupled to both gate 20 and one of the flip-flops 12. This sets the flip-flop 12 so that its output is high. The output from the amplifier 30 is thus low and the resistor string is essentially shorted to ground from the node 31 corresponding to the output of the amplifier. The resistor string 16 and the capacitor 25 together define a timing circuit which couples to the input of the resistance controlled square wave generator 26. The potentiometer 24 may be adjusted to conrol the precise frequency of operation of the generator 26. The output of the generator 26 which couples to inverter 27 is a square wave signal, the frequency of which is a function of which of the switches 10 has been closed by depressing its corresponding button on the instrument. Each of the switches 10 may be activated by a mechanical air valve associated with each of the accordion base notes.

In the drawing, the higher the switch 10 that is operated the higher is the frequency of operation of the generator 26. When the note B, for example, is played the output from the generator 26 may be a frequency of 1482.5 Hertz. This output is coupled by way of inverter 27 to a flip-flop 32. The output from flip-flop 32 divides this frequency down so that in the given example the output frequency from flip-flop 32 is 741.25 Hertz. Thus, when any note is played there is a first audio signal on line 33 at a frequency corresponding to the note that is played. Concurrently there is a second audio frequency signal on line 34 which is at a frequency one octave lower than the signal on line 33.

It has been mentioned that the left hand of a standard accordion is arranged so that there are only 12 base notes. The circuitry of the present invention including the gates 20 and 22 allows the accordianist to play 18 base notes or one and one half octave without changing his playing technique. In the disclosed embodiment the circuitry effectively expands by one half octave. However, it is understood that the expansion can also be by more or less than one half octave. In the disclosed embodiment the octave that is played is essentially separated into two separate fields 20A and 22A with the correponding input coupling respectively to gate 20 and 22 as shown in the drawing. The field 20A covers the notes B, A♯, A, G♯, G and F♯while field 22A covers the notes F, E, D♯, D, C♯, C. The half-octave expander logic functions so that if a note in the field 22A is played the note is essentially unaltered by the circuitry. However, if a note in field 20A is played after having played a note in field 22A, then there is an alternating action with the notes being played at one of two different frequencies spaced by an octave.

Thus, if, for example, the note D is played, the gate 22 has a high output which is coupled by way of the diode 22B and the differentiation circuit 21 to line 14 to cause all of the flip-flops 12 to be reset with the exception of the flip-flop 12 corresponding to the D switch 10. The high output from gate 22 sets the output of gate 36 at its low level and the output of gate 38 at its high level. Gate 40 is thus enabled while gate 42 is inhibited. Thus, the signals on lines 33 and 34 cannot be coupled by way of gate 42 and only the higher frequency signal on line 33 is coupled by way of gate 40 to the output NAND gate 44. Thus, any note that is played in that field 22A causes an output audio signal from gate 44 that corresponds in frequency with the note that is played. Thus, the note is essentially unaltered when the note comes from that field 22A.

On the other hand, if after a note in field 22A is played, then a note in field 20A is played the output from gate 20 which was previously low reverts to its high level causing flip-flop 46 to toggle. Previous to the toggling of flip-flop 46 gate 48 may have been enabled and gate 50 may have been inhibited by virtue of the connections from flip-flop 46 to these respective gates. Under that condition only the higher frequency signal from line 33 is coupled by way of gate 48 to the output gate 44. Now, when the next note in field 20A is played after having played a note in field 22A, the flip-flop 46 toggle as previously mentioned and now the gate 50 is enabled rather than the gate 48. This then essentially passes the signal only from line 34 which is the low octave frequency signal. Thus, by toggling the flip-flop 46 the gates 48 and 50 essentially alternately pass either the high octave or low octave signal as long as a note in field 22A has been played inbetween.

In the example just given where one of the notes of field 20A is played, if a second note in that field is played the output from the gate 20 is maintained high and the flip-flop 46 does not again toggle. Thus, if a series of notes in field 20A is played, the flip-flop 46 stays in its last position and the notes do not alternate between octaves. This is desired where one wishes to play a chromatic scale without having an alternation between octaves. Also, if a series of notes all in field 22A are played, one after the other, the gate 42 remains inhibited and the gate 40 is enabled so that there is no alternation in octave and even though one of the gates 48 or 50 may be enabled. Because gate 42 is inhibited, no signals can pass to the output gate 44 via the route of gate 42.

One of the advantageous features of the present invention is that the gate 20 and 22 can easily be modified to recieve greater than six inputs. In this way, if one wishes to expand by more or less than a half octave it is quite simple to rearrange the connections. For example, gate 20 may receive four inputs while gate 22 receives eight inputs. In this way, there is only a one-third octave expansion.

When a note is played in either of the fields 20A or 22A a positive pulse occurs by way of either diode 20B or 22B. These pulses as previously mentioned coupled to line 14 for resetting the flip-flops 12. Also, this positive going pulse couples via diode 51 to the sustain circuit 54. Similarly, the pulse couples by way of capacitor 55 to the base pluck circuit 56. The main audio signal from gate 44 couples to divider 58 which provides a divide by two, divide by three and divide by six output. The output from divider 58 on line 58A couples to the string bass circuit 60. The output on line 58B couples to the high bass circuit 62. The output on line 58C couples to the low bass circuit 64. These string, high and low bass circuit comprise conventional low pass filters including a series of resistors and capacitors connected in a conventional ladder network. The divider 58 is used along with the low pass filter circuits to shape the output wave form to one that most nearly simulates a string bass instrunment. The sustain circuit 54 includes a capacitor 57 that tends to store the pressed note and includes a potentiometer 59 for adjusting the amount of sustain. This control voltage is coupled to both the high bass circuit and the low bass circuit 64. The output from the bass circuitry is on line 70. This output may couple to further amplifier means and a speaker.

In order to accurately simulate a string bass there is also added the base pluck circuit 56. This circuit is also responsive to actuation of a key for providing an impulse across capacitor 68. This impulse signal essentially occurs at the beginning of the note. The bass pluck circuit 56 also receives input signals from the divider 58 and its output is coupled by way of a potentiometer to the output line 70. This bass pluck circuit shapes the characteristic so that there is an initial high amplitude pulse which simulates the plucking of a string instrument.

It has been found that by using a divider as shown that has the three different divides, one can quite accurately provide a string characteristic. With this divide sequence if, for example, the divide by six line has a signal of 50 Hertz then the divide by three line will have a signal of 100 Hertz and the divide by two line, a signal of 150 Hertz. Thus, there is a fundamental frequency and first and second harmonics which are mixed by the output bass circuitry.

What is claimed is:

1. An electronic device for use with a musical instrument having bass buttons for simulating a bass string instrument comprising;

a plurality of switch means each operatively associated with a botton and responsive to actuation of its associated button, means coupled from said plurality of switches for establishing a first octave audio signal of a frequency corresponding to the note played, and a second octave audio signal of a frequency corresponding to a note an octave adjacent the one played, and logic means including first means responsive to the playing of notes of a first field of the octave, second means responsive to the playing of notes of a second field of the octave, and alternating means responsive to a note being played in said first field for passing in one state the first octave audio signal and in another state the second octave audio signal.

2. An electronic device as set forth in claim 1 wherein said means for establishing including a wave generator having a frequency corresponding to the note played.

3. An electronic device as set forth in claim 2 including a frequency divider coupler from the wave generator, the first audio signal being taken from the wave generator and the second audio signal being taken from the frequency divider.

4. An electronic device as set forth in claim 3 including a bistable device associated with each switch and a resistor string having a plurality of nodes which are respectively coupled to the bistable devices, the resistor string being shorted to provide different resistances for operating the wave generator at different frequencies.

5. An electronic device as set forth in claim 1 wherein the first means includes a gate circuit and the second means includes a gate circuit.

6. An electronic device for use with a musical instrument having bass buttons for simulating a bass string instrument comprising;

a plurality of switches each associated with a button and responsive to actuation of its associated button, means coupled from said plurality of switches for establishing a first octave audio signal of a frequency corresponding to the actuated button, and a second octave audio signal of a frequency corresponding to a note an octave adjacent the one played, and logic means responsive to actuation of predetermined ones of said buttons and including a first means for detecting notes of a first field of the octave that is played, second means for detecting notes of a second field of the octave that is played, and a bistable means coupled from said first means and responsive to a note being played in said first field after a note of said second field for changing the state of said bistable means.

7. An electronic device as set forth in claim 6 wherein said logic means further includes gate means responsive to operation of said second means for passing only said first audio signal.

8. An electronic device as set forth in claim 7 including a pair of gates coupled from said bistable means for passing said first and second audio signals, respectively.

9. An electronic device as set forth in claim 1 including an impulse circuit responsive to actuation of a button and means for mixing the output of the impulse circuit with the selected audio signal.

10. An electronic device as set forth in claim 1 wherein said alternating means can alternate between positions only when a note of the second field is played between notes of the first field.

11. An electronic device as set forth in claim 1 wherein said alternating means includes a bistable means and a pair of gates for respectively receiving the first and second octave audio signals.

* * * * *